US006033527A

United States Patent [19]

Waech et al.

[11] Patent Number: 6,033,527

[45] Date of Patent: Mar. 7, 2000

[54] PAPER MACHINE EDGE FIBER ALIGNMENT CONTROL BY ANGLED HEADBOX SIDES

[75] Inventors: Theodore G. Waech, Janesville; Nicolas A. Reinke, Hanover, both of Wis.

[73] Assignee: Beloit Technologies, Inc., Wilmington, Del.

[21] Appl. No.: 09/110,585

[22] Filed: Jul. 6, 1998

[51] Int. Cl.[7] ..... D21F 1/02

[52] U.S. Cl. ..... 162/336; 162/343; 162/346

[58] Field of Search ..... 162/336, 343, 162/344, 346

[56] References Cited

U.S. PATENT DOCUMENTS

| | | | |
|---|---|---|---|
| 4,687,548 | 8/1987 | Ilmoniemi et al. | 162/216 |
| 4,897,158 | 1/1990 | Weisshuhn et al. | 162/343 |
| 4,897,160 | 1/1990 | Wolf et al. | 162/343 |
| 4,906,336 | 3/1990 | Weisshuhn et al. | 162/343 |
| 4,927,499 | 5/1990 | Wikman | 162/336 |
| 4,980,026 | 12/1990 | Kade | 162/336 |
| 5,124,002 | 6/1992 | Kade | 162/343 |

*Primary Examiner*—Karen M. Hastings

[57] ABSTRACT

A headbox is provided which provides an improved uniformity in the velocity profile of the stock solution across the slice opening. As a result, improved fiber alignment is provided across the width of the entire slice opening and mis-alignment of the fibers towards the outer edges of the slice opening is avoided. The headbox includes an improved nozzle design with pondsides that are not parallel to one another but which are angled inwardly as they extend from the tube bank to the slice opening. Further, several columns of outer tubes of the tube bank may also be angled inwardly as they extend from the header to the nozzle section. The center tubes would be disposed in a parallel relationship to one another. A sealing arrangement is provided between the roof of the nozzle section and the pondside which permits the incorporation of a double knuckle for extending and retracting the roof to adjust the L/b ratio. In an alternative embodiment, the roof includes a rectangular extraction which is retracted and extended by a double knuckle and which needs no special sealing arrangement between the extension and the pondsides.

24 Claims, 5 Drawing Sheets

10
11
12
13
14
15
16
17
17a
17b
18
21
22
23
24
25
26

PAPER MACHINE EDGE FIBER ALIGNMENT CONTROL BY ANGLED HEADBOX SIDES

BACKGROUND OF THE INVENTION

FIELD OF THE INVENTION

The present invention relates to an apparatus for improving the fiber alignment at the opposing edges of the headbox outlet of a papermaking machine and for controlling the qualities of the edges of the rolls of paper or paperboard being manufactured. More specifically, the present invention relates to an improved nozzle section design and an improved tube bank design of a headbox which results in improved fiber alignment at the edges of the nozzle outlet and also provides a consistent basis weight across the entire roll of paper or paperboard, including the edges.

In the manufacture of paper and paperboard, it is important to achieve a flow of stock suspension out of the nozzle section of the headbox having a uniform machine direction velocity profile. In other words, the speed and direction of the flow of stock in the middle of the nozzle should be the same or as close to the same as possible as the speed and direction of the stock flowing at or near the edges of the nozzle. When the machine direction velocity profile of the stock changes across the width of the nozzle, the basis weight or grammage and the fiber alignment of the resulting product will vary across the width or roll of product. As a result, printers or purchasers of paper and paperboard rolls often avoid the purchase of "edge rolls" because they differ in basis weight or fiber alignment. Further, if the paper fiber alignment varies from the machine direction, the misalignment can result in breaks in the paper during production. As a result, the paper production must be interrupted. Still further, when the paper fiber alignment varies from the machine direction, paper is produced with dimensional stability problems. Specifically, sheets of paper cut from the roll will not have consistent dimensions and therefore, as a result, a stack of sheets from the roll may not lay flat with square corners but may exhibit a curled or waviness appearance when laid flat on a table. This problem is particularly evident for some specialized computer papers that are folded in an accordion-like fashion. Such paper with dimensional stability problems may not form a square stack which clearly signifies to the consumer that the paper is of an inferior quality.

The specific problem associated with the headbox or, more specifically, the nozzle section of the headbox, is illustrated in FIGS. 1 and 2. Turning first to FIG. 1, a horizontal cross sectional view of a headbox 10 is illustrated which includes a header 11 connected to a tube bank 12 which is disposed between the header 11 and a nozzle section 13. The input flow of the stock suspension shown at 14 and a small output flow of stock suspension is shown at 15. However, the majority of the stock suspension is delivered to the nozzle section 13 through the plurality of parallel tubes shown generally at 16. The suspension then flows through the nozzle section 13 and outward to a forming section (not shown) in the direction of the arrows shown generally at 17.

FIG. 1 illustrates an idealized solution whereby the stock flows outward from the nozzle section 13 with a uniform velocity profile as illustrated by the arrows 17. In other words, in an ideal solution, the velocity profile across the width of the nozzle section 13 is uniform. However, those skilled in the art have long recognized that a uniform velocity profile exiting the slice opening 18 is not uniform but varies at the outer edges 21, 22 of the slice opening 18 as illustrated schematically in FIG. 2. More specifically, it has been found that friction between the flow of stock against the pondsides 23, 24 (or sidewalls) of the nozzle section 13 results in velocity profiles 17*a*, 17*b* at the opposing edges 21, 22 of the slice opening which are not in alignment with the machine direction (see the arrows 17) but which are dispersed outwardly from the machine direction indicated by the arrows shown at 17. The outward, non-aligned profiles shown at 17*a*, 17*b* adversely affect the edge portions of a roll of product being manufactured. Specifically, the edge portions of the roll will not have the same basis weight or fiber alignment as the center of the roll and, accordingly, many consumers of the roll product do not like to purchase material formed at the edges of the roll and the edge portion might be sold at a discounted price or even recycled.

Accordingly, there is a need for an improved headbox configuration which will avoid the velocity profile illustrated in FIG. 2 and more closely approximate the velocity profile illustrated in the idealized situation shown in FIG. 1.

SUMMARY OF THE INVENTION

The present invention satisfies the aforenoted need by providing an improved nozzle section design and/or an improved nozzle section design in combination with an improved tube bank design which generates a more uniform velocity profile across the width of the slice opening.

In an embodiment, the present invention provides a nozzle section having two vertical pondsides (or sidewalls). Each pondside has an inlet end connected to the tube bank and an outlet end disposed at the slice opening. The pondsides are connected to the tube bank at an angle and are directed inwardly towards each other as the pondsides extend from the tube bank towards the slice opening. Therefore, the pondsides are not parallel to one another but provide the nozzle section with a slightly tapered configuration as the nozzle section extends from the tube bank to the slice opening.

In an embodiment, the angle at which the pondsides are connected to the tube bank ranges from about 2° to about 15°.

In an embodiment, the angle at which the pondsides are connected to the tube bank is greater than 2°.

In a preferred embodiment, the angle at which the pondsides are connected to the tube bank is about 8°. In typical papermaking machines, use of an angle of about 8° enables an additional vertical row of tubes to be employed at each side of the tube bank, 4° enables one additional vertical row of tubes.

In an embodiment, the nozzle section of the present invention also comprises a roof and an apron (or bottom panel). The roof and apron are disposed between the two pondsides, and the roof, apron and two opposing pondsides form a slice channel. The roof includes two opposing edges, each edge facing one of the pondsides. Each opposing edge of the roof accommodates a seal extending along the edge of the roof from the tube bank to the slice opening. The seal is biased outwardly against the pondside to which it faces and provides a seal between the roof and the pondside. With such a sealing arrangement, the roof can be connected to an actuator system, commonly referred to as a double knuckle, which can retract the roof rearwardly towards the tube bank to increase the L/b ratio wherein L represents the lateral distance between the forward end of the roof and the forward end of the apron and b represents the height of the slice area or the vertical distance between the apron and the forward end of the roof or move the roof forwardly towards the slice opening to decrease the L/b ratio.

In an embodiment, the roof of the nozzle section has a trapezoidal configuration.

In an embodiment, each pondside comprises a first section connected to the tube bank at an angle. Each first section of each pondside is also connected to a second section. The second section extends from the first section to the slice opening. The second sections of the pondsides are disposed parallel to one another; the first sections of the pondsides are not disposed parallel to one another but are connected to the tube bank at an angle and extend inwardly toward one another as they extend toward the second section from the tube bank. Thus, only the first section of each pondside has the inwardly directed configuration and the second section, in combination with the roof and apron form a straight channel or a channel of uniform width.

In an embodiment, the second sections of the pondsides have a length of less than 2".

In an embodiment, the second sections of the pondsides have a length ranging from about 2" to about 30".

In an embodiment, the second sections of the pondsides have a length of about 10".

In an embodiment, the first sections of the pondsides are connected to the tube bank at an angle ranging from 2° to about 15°.

In an embodiment, the first sections of the pondsides are connected to the tube bank at an angle greater than 2°.

In an embodiment, the first section of the pondsides are connected to the tube bank at an angle of about 8°.

In an embodiment, the tube bank comprises a plurality of tubes extending from the header to the nozzle section. The plurality of tubes further includes outer tubes with a plurality of inner tubes disposed between the outer tubes. The outer tubes are disposed outside of the inner tubes. The outer tubes are not disposed in a parallel relationship to one another but, instead, are directed inwardly towards each other and away from their respective headbox sides as the outer tubes extend from the header towards the nozzle section. Thus, like the pondsides of the nozzle section, the outer tubes of the tube bank are not arranged parallel to one another but are directed inwardly towards each other as they extend towards the nozzle section.

In an embodiment, the outer tubes are disposed at an angle with respect to the center tubes of the tube bank that is greater than 2°.

In an embodiment, the outer tubes of the tube bank are disposed at an angle with respect to the center tubes of the tube bank that ranges from about 2° to about 15°.

In an embodiment, the outer tubes of the tube bank are disposed at an angle of about 8° with respect to the center tubes of the tube bank.

It is therefore an advantage of the present invention to provide an improved nozzle section for a headbox that generates a uniform stock suspension velocity profile across the width of the nozzle or slice opening.

Another advantage of the present invention is that it provides an improved tube bank design which helps to generate a more consistent velocity profile for the stock solution exiting the nozzle section.

Yet another advantage of the present invention is that it provides a headbox that generates improved fiber alignment in the machine direction axis.

Still another advantage of the present invention is that it provides an improved headbox design which results in paper and paperboard with improved dimensional stability.

Still another advantage of the present invention is that it provides an improved headbox design which generates improved fiber alignment across the entire width of a roll of paper or paperboard being manufactured and therefore provides a roll of paper or paperboard with a consistent basis weight across the entire width of the roll.

And another advantage of the present invention is that it provides an improved apparatus for manufacturing paper and paperboard on rolls whereby the edge material is of the same quality and characteristics as the material disposed towards the center of the roll.

These and other advantages will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figures 1, 2:
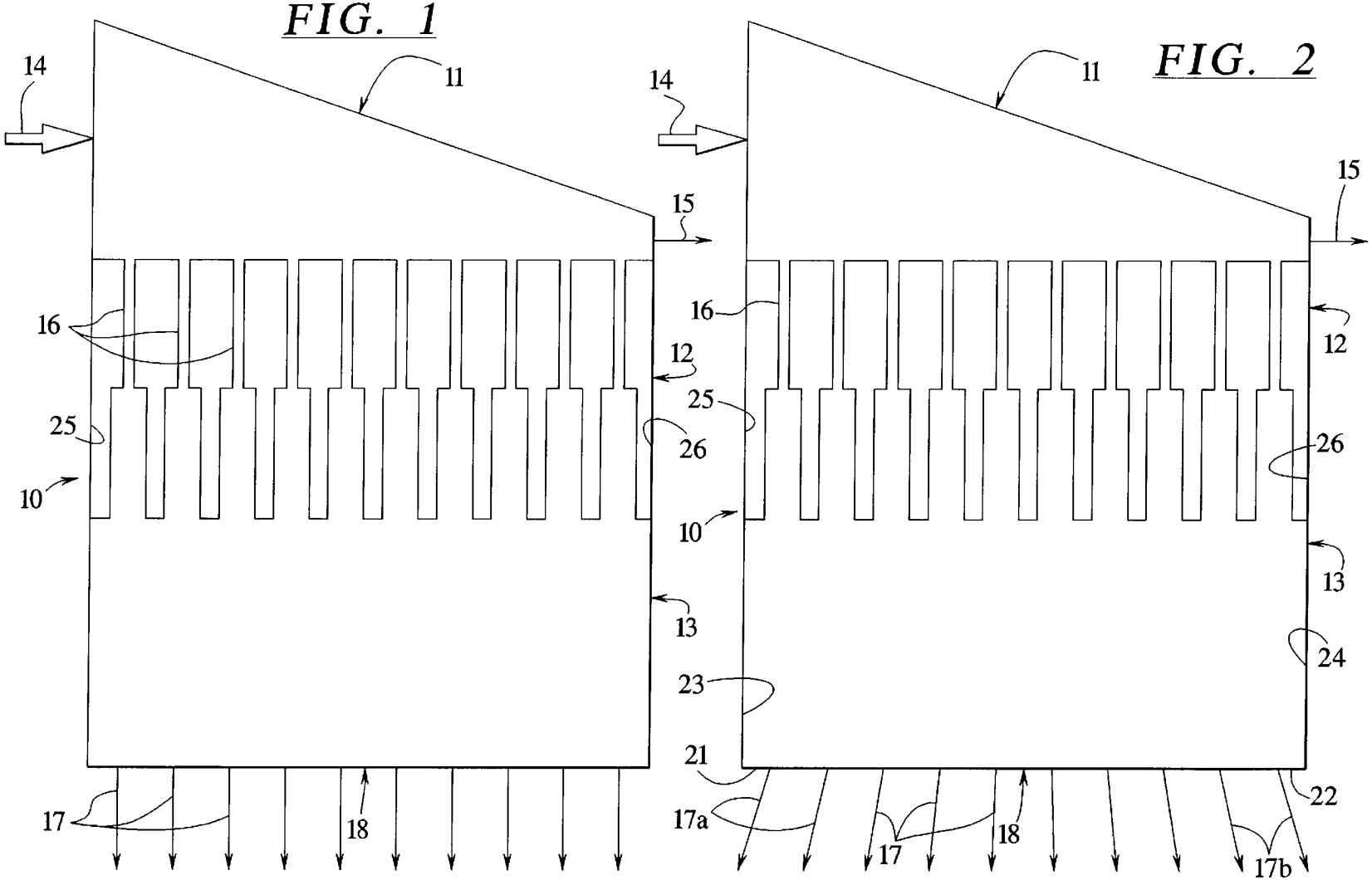
FIG. 1 is a schematic illustration of a headbox and idealized stock solution velocity profile.
FIG. 2 is another schematic illustration of a headbox which more accurately illustrates an actual velocity profile of the stock solution exiting the nozzle section.

Turning first to FIGS. 1–3, it will be noted that FIG. 1 illustrates an idealized situation whereby the velocity profile of the stock departing the nozzle section 13 is uniform and the fibers are aligned in the machine direction as illustrated by the arrows shown at 17. In contrast, FIG. 2 illustrates the actual situation when parallel pondsides 23, 24 are utilized with parallel tubes 16 that are also parallel with the planes shown at 25, 26 that are coplanar with the pondsides 23, 24 respectively. The inventors have found that the velocity profile towards the edges 21, 22 of the slice opening 18 are directed outwardly as indicated by the arrows 17*a* and 17*b*. This mis-alignment with respect to the machine direction (see the arrows 17) results in misalignment of the fiber at the edges of a roll being manufactured and further causes the basis weight of the paper or paperboard to vary, particularly at the opposing edges of the roll of paper or paperboard being manufactured.

Figure 3A:
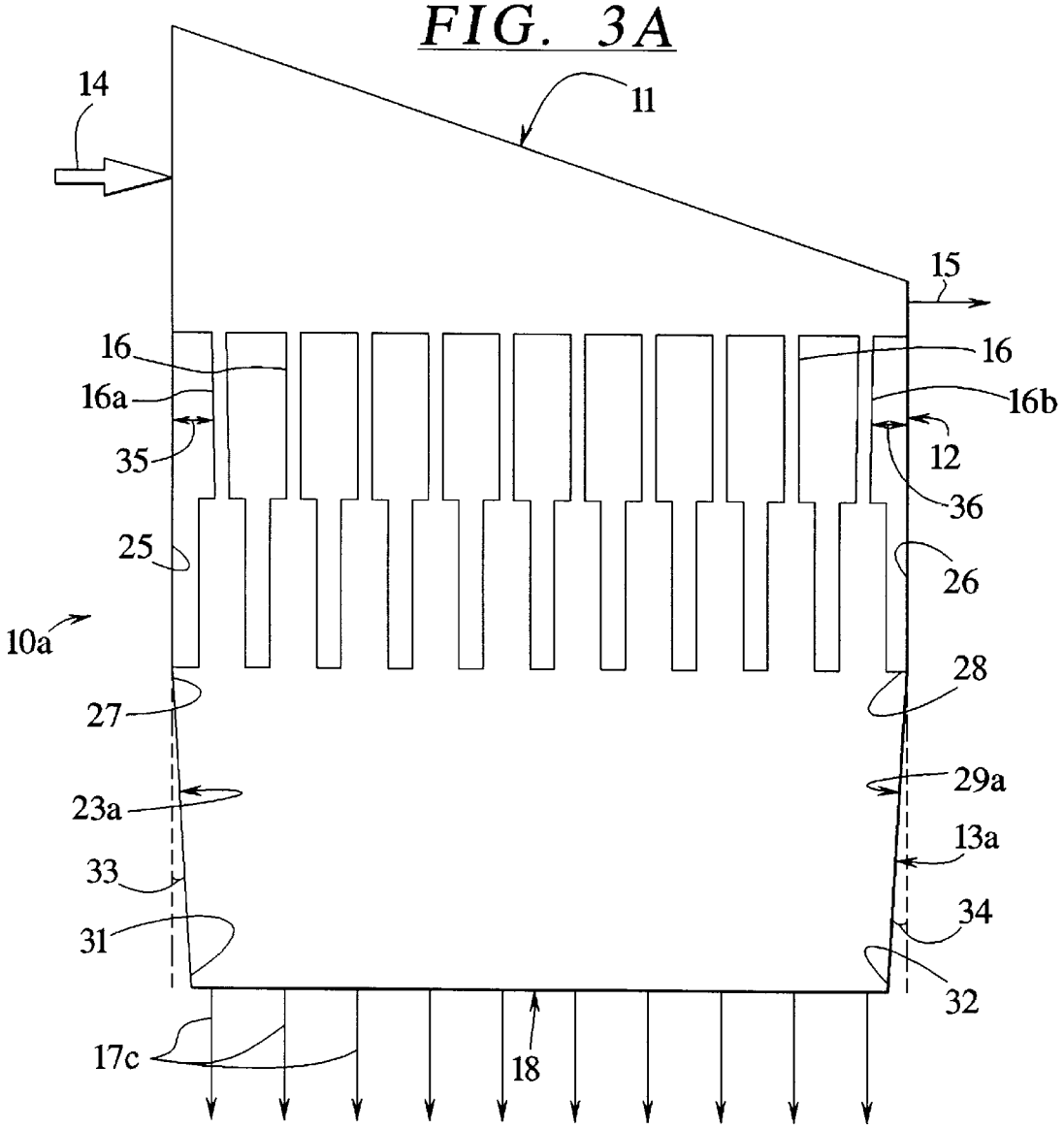
FIG. 3A is a schematic illustration of a headbox made in accordance with the present invention, particularly illustrating a headbox with angled tubes and angled pondsides.

In order to remedy this situation, the headbox 10*a* as shown in FIG. 3A was developed. The headbox 10*a* shown in FIG. 3A differs from the headboxes 10 shown in FIGS. 1 and 2 in two different aspects. Specifically, the pondsides 23*a*, 24*a* of the 25 nozzle section 13*a* are not coplanar with the planes shown at 25, 26 of the tube bank 12. Further, the pondsides 23*a*, 24*a* shown in FIG. 3A are not parallel to one another. Instead, the pondsides 23*a*, 24*a* extend inwardly toward each other as shown in FIG. 3A. More specifically, as the pondside 23*a* extends from its inlet end 27, which is connected to the plane 25 of the tube bank 12, towards its outlet end 31, which is disposed at the slice opening 18, the pondside 23*a* extends inwardly at an angle 33 with respect the plane of the plane 25 of the tube bank 12. Similarly, as the pondside 24*a* extends from its inlet end 28 towards its outlet end 32, which is disposed at the slice opening 18, the pondside 24*a* is angled inwardly at an angle 34 with respect to the plane 26. In most embodiments, the angles shown at 33 and 34 will be the same. The angles may range from 2°0 to 15°. In one preferred embodiment, the angle 33 is about 8°.

As a result of disposing the pondsides 23*a*, 24*a* at an angle 33, 34 respectively, such as 8°, a uniform velocity profile 17*c* through the slice opening 18 is achieved.

Figure 3B:
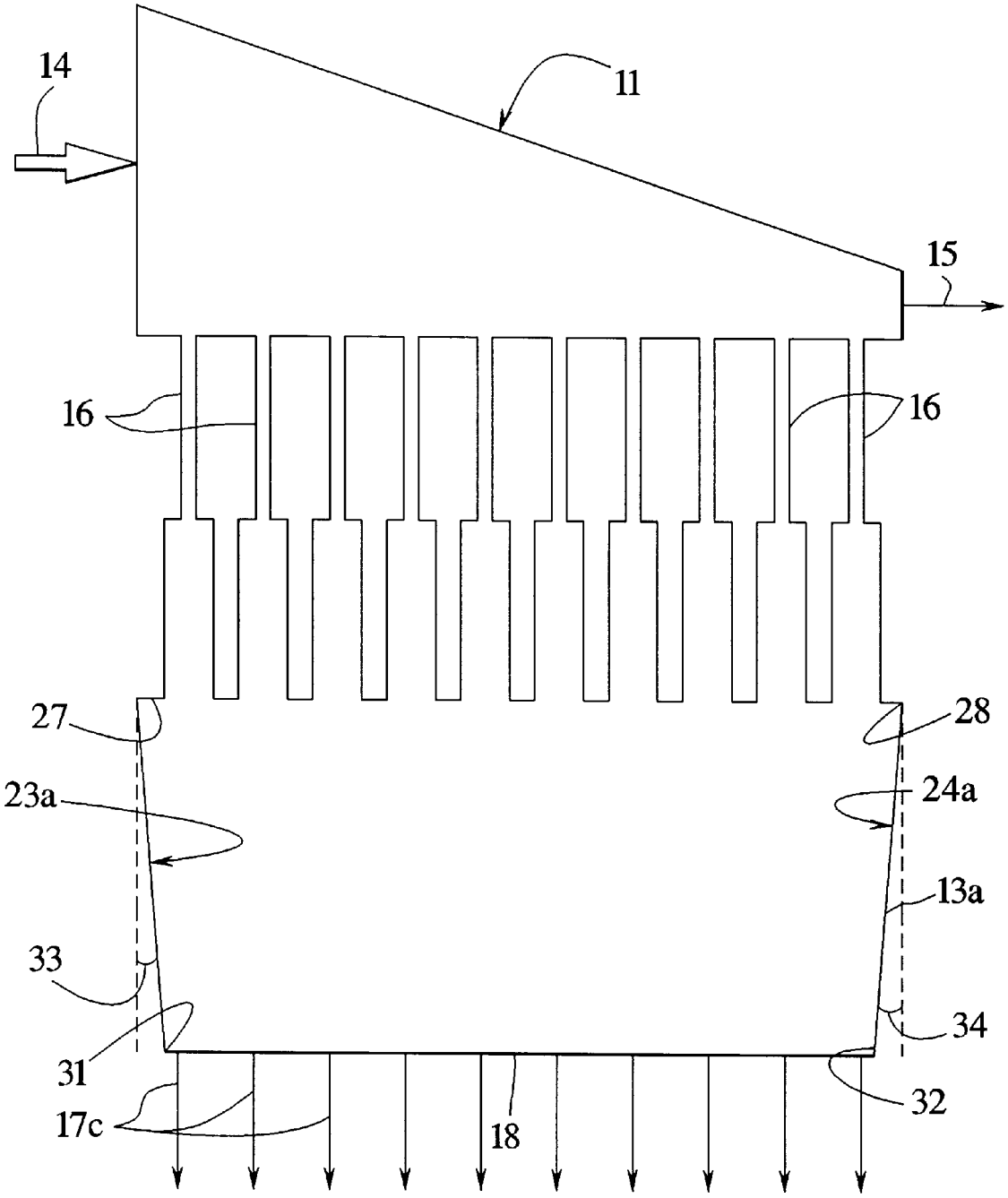
FIG. 3B is a schematic illustration of another headbox made in accordance with the present invention, particularly illustrating a headbox with angled pondsides and straight or parallel tubes.
Figure 3C:
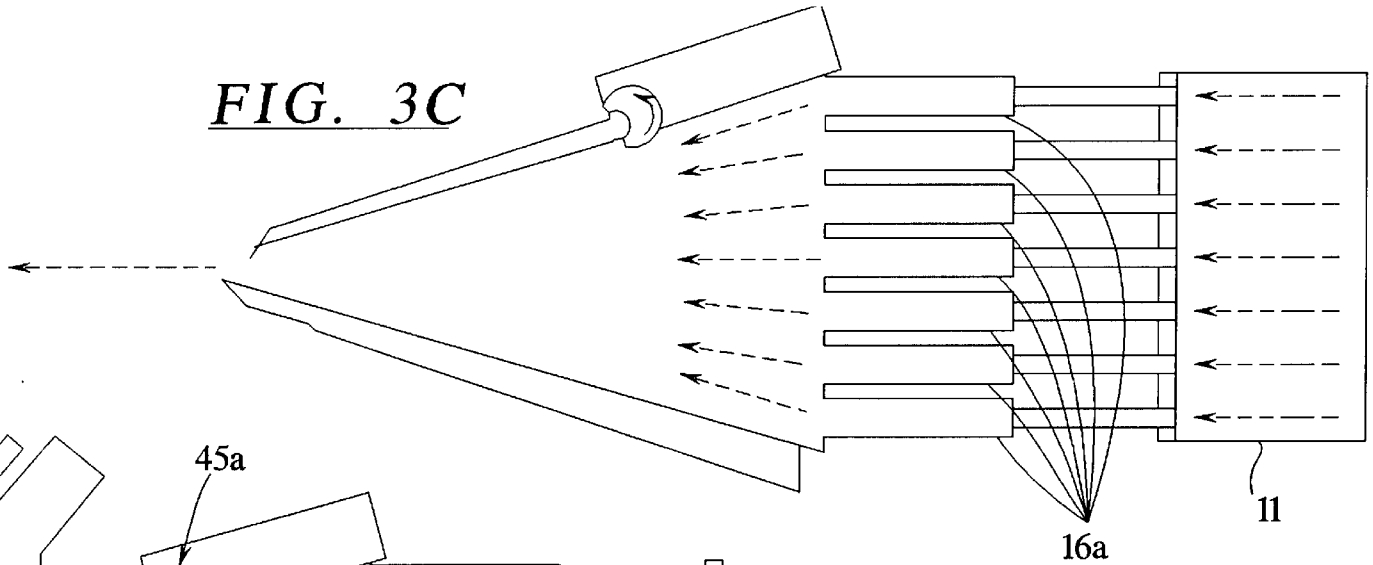
FIG. 3C is a side sectional view of the headbox shown in FIG. 3A.

In one embodiment, the angled pondsides 23*a*, 24*a* are used in combination with parallel tubes 16 as shown in FIG. 3B. In another embodiment, which is illustrated in FIG. 3A, the angled pondsides 23*a*, 24*a* are used in combination with angled outer tubes 16*a*, 16*b* as shown in FIG. 3A. Each outer tube 16*a*, 16*b* is disposed at an angle 35, 36 with respect to the parallel planes 25, 26. In most embodiments, the angles 35, 36 will be equal. The angles 35, 36 may range from 2° to 15° and, more preferably, are about 8°. Other tubes 16 disposed between the outer tubes may be angled as well. As shown in FIG. 3C, entire vertical rows of tubes 16a may be angled inwardly.

It will be noted that the angles 33, 34, 35 and 36 will depend upon the flowrate through the tubes 16, 16*a* and 16*b* as well as the flowrate through the nozzle section 13*a*. Also, as noted above, it is anticipated that using the angled pondsides 23*a*, 24*a* alone, without utilizing angled outer tubes 16*a*, 16*b* will provide a positive result and a uniform velocity profile. However, the use of both the angled pondsides 23*a*, 24*a* and angled outer tubes 16*a* and 16*b* may also be necessary in some cases, depending upon the flowrate and properties of the stock solution.

Figure 5:
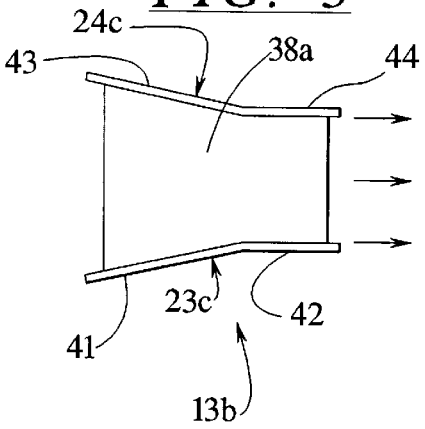
FIG. 5 is a top plan view of the roof of another embodiment of a nozzle section made in accordance with the present invention.
Figure 4:
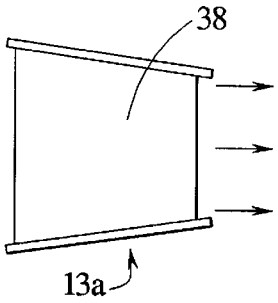
FIG. 4 is a top plan view of the roof of a nozzle section made in accordance with the present invention.

Turning to FIG. 4, the roof 38 of a nozzle section 13*a* may be trapezoidal in configuration. However, referring to FIG. 5, the roof 38*a* may have an irregular hexagonal configuration as shown in FIG. 5 due to the configuration of the pondside 23*c*, 24*c*. Specifically, the pondside 23*c* includes a first section 41 and a second section 42. The first section 41 is angled with respect to the tube bank 12 as illustrated in FIG. 3A and 3B. However, the second section 42 is disposed parallel to the tube bank 12. Similarly, the first section 43 of the pondside 24*c* is disposed at an angle with respect to the outer plane 26 of the tube bank 12 (see FIG. 3) but the second section 44 is disposed parallel to the outer planes 25, 26 of the tube bank 12 and is also disposed parallel to the second section 42 of the pondside 23*c*. The extension of the nozzle section 13*b* provided by the second sections 42, 44 of the pondsides 23*c*, 24*c* further enhances the ability of the nozzle section 13*b* to generate a consistent velocity profile that is aligned with the machine direction. The length of the second sections 42, 44, or the extension of the nozzle section 13*b*, can range from about 2" to about 30", is preferably greater than 2" and still more preferably is about or greater than 10".

Figure 8:
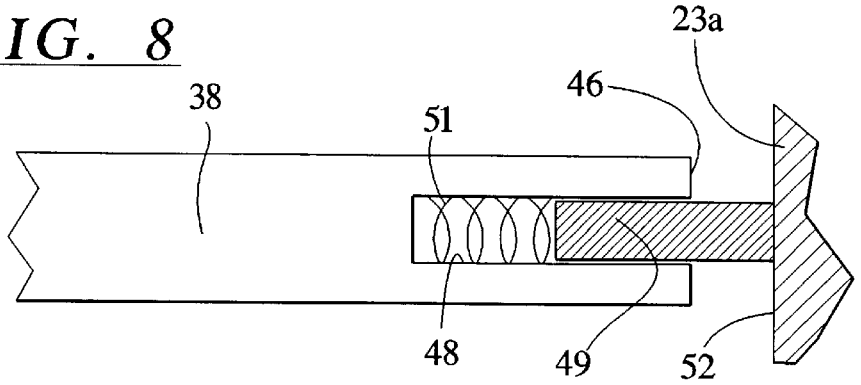
FIG. 8 is a partial sectional view of the nozzle section shown in FIG. 6.
Figure 7B:
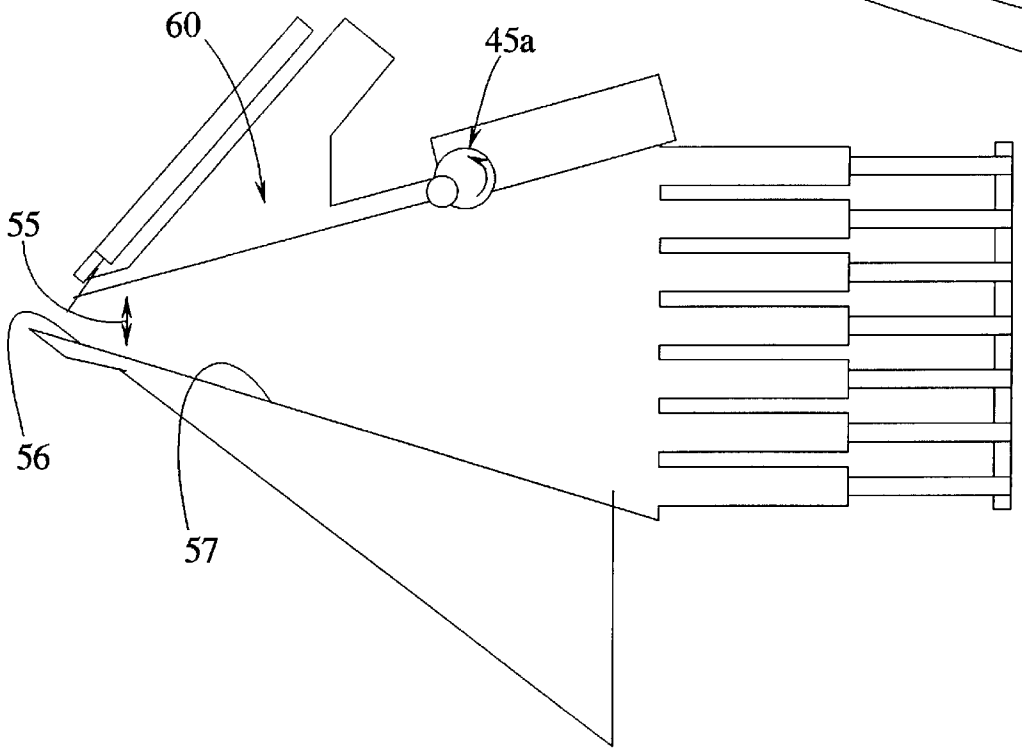
FIG. 7B is a side view of a nozzle section similar to the one shown in FIG. 7A, but with greater detail regarding the double knuckle actuator.
Figure 6:
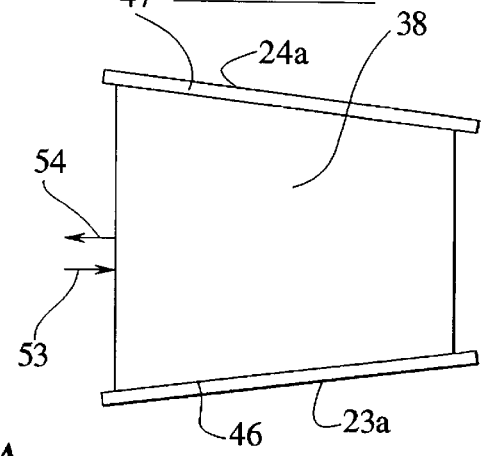
FIG. 6 is a top plan view of a nozzle section made in accordance with the present invention.
Figure 7A:
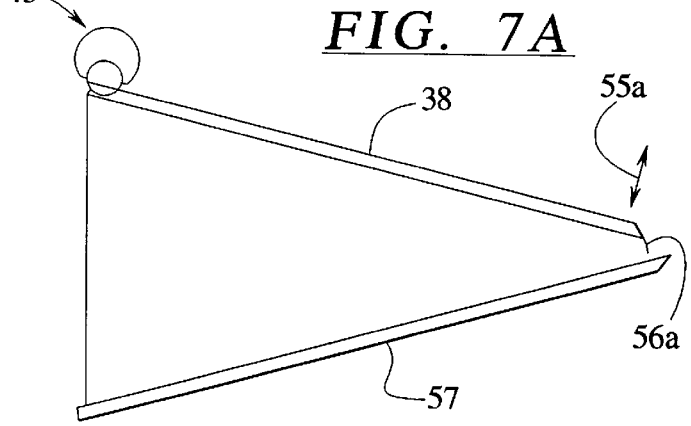
FIG. 7A is a side view of the nozzle section shown in FIG. 6.

Turning to FIG. 6, if a trapezoidal roof 38 is employed that can be retracted or extended by way of a double knuckle actuator 45 as shown in FIG. 7A, a seal must be provided between the edges 46, 47 of the roof 38 and the pondsides 23*a*, 24*a*. A suitable sealing mechanism is illustrated in FIG. 8. Specifically, the edge 46 of the roof 38 includes a slot 48 that accommodates a seal 49 and a biasing element 51, such as springs or compressed gas. The seal 49 is biased against the inside surface 52 of the pondside 23*a*. Thus, as the roof 38 is extended or retracted in the direction of the arrows 53, 54 by actuating the double knuckle 45, the biasing element 51 ensures that the seal 49 engages the inside surface 52 of the pondside 23*a*. An identical arrangement is provided for the opposing side or opposing edge 47 of the roof 38.

As shown in FIG. 7B, it will be noted that a double knuckle 45*a* can also be used to adjust the tilt of the top panel 60 either upward or downward as indicated by the arrows shown at 55 for adjusting the width of the slice opening 56. The apron or bottom panel is shown at 57. Referring back to FIG. 7A, the double knuckle 45 could also be used in combination with an actuator (not shown) for moving the roof 38 in an upward and downward direction as shown by the arrows 55*a* to control the width of the slice opening 56*a*. The use of double knuckles are well known to those skilled in the art and need not be discussed in detail here.

Figure 9:
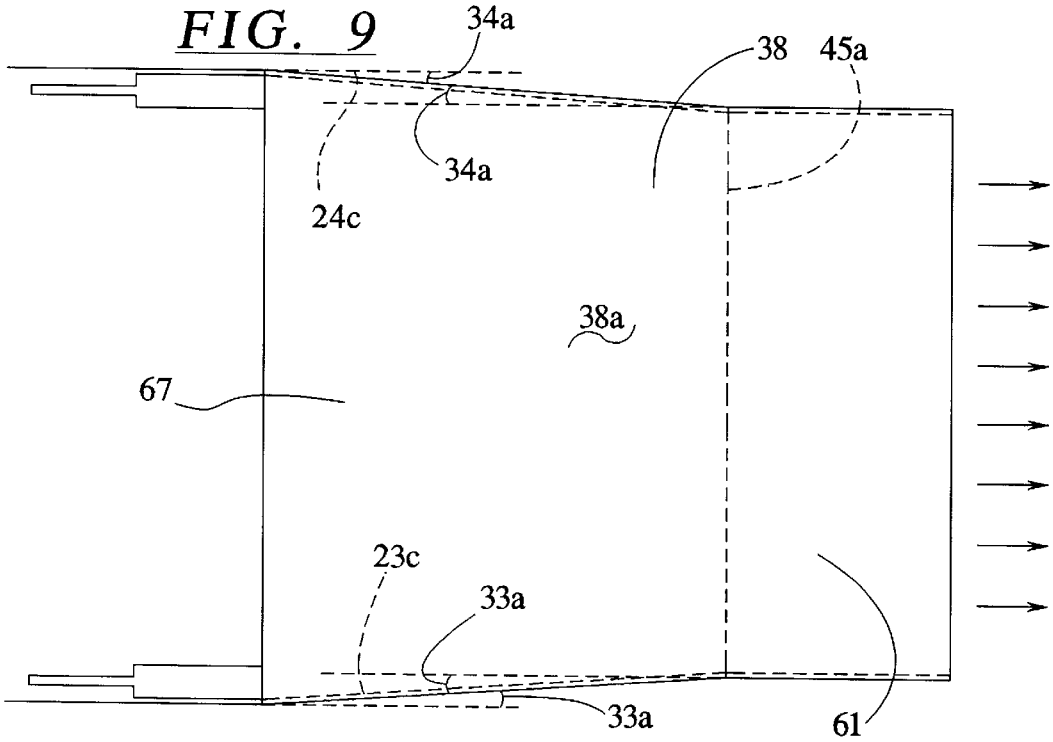
FIG. 9 is a partial top plan view of a tube bank and a nozzle section incorporating the roof configuration shown in FIG. 5.

The roof configuration shown in FIG. 5 is illustrated in greater detail in FIG. 9. The double knuckle is shown schematically at 45*a*. Accordingly, only the forward rectangular section 61 of the roof 38*a* is retracted and extended when controlling the L/b ratio. Therefore, there is no sealing problems associated with the rear section 62 of the roof 38*a* with respect to the pondsides 23*c* and 24*c*.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A nozzle section for a headbox having a tube bank, the nozzle section comprising:

two vertical pondsides, each pondside having an inlet end connected to the tube bank and an outlet end disposed at a slice opening, the pondsides are directed inwardly towards each other as the pondsides extend from the tube bank towards the slice opening, each pondside comprising a first section connected to the tube bank at an angle and a second section connected to the first section and disposed between the slice opening and the first section, the second sections of the two pondsides being disposed parallel to one another.

2. The nozzle section of claim 1 wherein the pondsides are connected to the tube bank at an angle, said angle ranges from about 2° to about 15°.

3. The nozzle section of claim 1 wherein the pondsides are connected to the tube bank at an angle, said angle is greater than 2°.

4. The nozzle section of claim 1 further comprising a roof and an apron disposed between the two pondsides, the roof, apron and pondsides forming a slice channel, the roof comprising two opposing edges extending from the tube bank to the slice opening, each edge of the roof accommodating a seal extending along the edge of said roof, each of the seals engaging one of the pondsides and providing a sealing engagement between the roof and said one of the pondsides.

5. The nozzle section of claim 4 wherein the seals disposed in the edges of the roof are biased outward against the pondsides.

6. The nozzle section of claim 1 further comprising a roof and an apron disposed between the two pondsides, the roof having a trapezoidal configuration.

7. The nozzle section of claim 1 wherein said angle ranges from about 2° to about 15°.

8. The nozzle section of claim 1 wherein said angle is greater than 2°.

9. The nozzle section of claim 1 wherein the second sections of the pondsides have a length greater than 2".

10. The nozzle section of claim 1 wherein the second sections of the pondsides have a length ranging from about 2" to about 30".

11. A headbox comprising:

a header connected to a tube bank which is connected to a nozzle section, the tube bank being disposed between the header and the nozzle section, the tube bank comprising two sidewalls and a plurality of tubes, each of the plurality of tubes extending from the header to the nozzle section, the plurality of tubes including outer tubes with a plurality of inner tubes disposed between the outer tubes, each outer tube being disposed outside of the inner tubes, the outer tubes being directed inwardly towards each other as the outer tubes extend from the header towards the nozzle section, the nozzle section comprising two vertical pondsides, each pondside having an inlet end directed towards the tube bank and an outlet end disposed at a slice opening, each pondsides being directed inwardly towards each other at an angle of about 8° as the pondsides extend from the tube bank towards the slice opening, each pondside further comprising a first section connected to one of the sidewalls at said angle and a second section connected to the first section and disposed between the slice opening and the second section, the second sections of the two pondsides being disposed parallel to one another, the second sections have a length of greater than about 10", the nozzle section further comprising a roof and an apron disposed between the two pondsides, the roof comprising two opposing edges, each edge of the roof accommodating a seal extending along the edge of said roof, each of the seals engaging one of the pondsides and providing a sealing engagement between the roof said one of the pondsides, the apron comprising two opposing edges extending from the tube bank to the slice opening, each edge of the apron accommodating a seal extending along said edge of the apron, each of the seals engaging one of the pondsides and providing a sealing engagement between the apron and said one of the pondsides.

12. A headbox comprising:

a header connected to a tube bank which is connected to a nozzle section, the tube bank being disposed between the header and nozzle section, the tube bank comprising a plurality of parallel tubes, each of the plurality of tubes extending from the header to the nozzle section, the plurality of tubes including two vertical columns of outer tubes with a plurality of columns of inner tubes disposed between the vertical columns of outer tubes, the outer tubes being directed inwardly towards each other at a first angle as the outer tubes extend from the header towards the nozzle section, the nozzle section comprising two vertical pondsides, each pondside having an inlet end connected to the tube bank and an outlet end disposed at a slice opening, each pondsides being directed inwardly towards each other as the pondsides extend from the tube bank towards the slice opening.

13. The headbox of claim 12 wherein the first angle ranges from about 2° to about 15°.

14. The headbox of claim 12 wherein the first angle is greater than 2°.

15. The headbox of claim 12 wherein each pondside is connected to the tube bank at a second angle, said second angle ranges from about 2° to about 15°.

16. The headbox of claim 12 wherein each pondside is connected to the tube bank at a second angle, said second angle is greater than 2°.

17. The headbox of claim 12 wherein the nozzle section further comprises a roof and an apron disposed between the two pondsides, the roof, apron and pondsides forming a slice channel, the roof comprising two opposing edges extending from the tube bank to the slice opening, each edge of the roof accommodating a seal extending along the edge of said roof, each of the seals engaging one of the pondsides and providing a sealing engagement between the roof and said one of the pondsides.

18. The headbox of claim 17 wherein the seals disposed in the edges of the roof are biased outward against the pondsides.

19. The headbox of claim 12 further comprising a roof and an apron disposed between the two pondsides, the roof having a trapezoidal configuration.

20. The headbox of claim 12 wherein each pondside comprises a first section connected to the tube bank and a second section connected to the first section and disposed between the slice opening and the first section, the second sections of the two pondsides being disposed parallel to one another, the first sections of the pondsides being directed inwardly towards each other.

21. The headbox of claim 20 wherein said first sections are connected to the tube bank at a second angle, the second angle ranges from about 2° to about 15°.

22. The headbox of claim 20 wherein said first sections are connected to the tube bank at a second angle, the second angle is greater than 2°.

23. The headbox of claim 20 wherein the second sections have a length greater than 2".

24. The headbox of claim 20 wherein the second sections have a length ranging from about 2" to about 30".

* * * * *